US010864755B2

(12) United States Patent
Otake

(10) Patent No.: US 10,864,755 B2
(45) Date of Patent: Dec. 15, 2020

(54) MANUAL SHEET JAM CLEARANCE IN PRINTER

(71) Applicant: TOSHIBA TEC KABUSHIKI KAISHA, Tokyo (JP)

(72) Inventor: Atsushi Otake, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/374,917

(22) Filed: Apr. 4, 2019

(65) Prior Publication Data

US 2019/0315135 A1 Oct. 17, 2019

(30) Foreign Application Priority Data

Apr. 16, 2018 (JP) ..... 2018-078333

(51) Int. Cl.

| | |
|---|---|
| ***B41J 11/00*** | (2006.01) |
| ***B41J 11/30*** | (2006.01) |
| ***B41J 2/22*** | (2006.01) |
| ***B41J 11/04*** | (2006.01) |
| ***B41J 15/04*** | (2006.01) |
| *B65H 20/20* | (2006.01) |

(52) U.S. Cl.

CPC ..... *B41J 11/006* (2013.01); *B41J 2/22* (2013.01); *B41J 11/04* (2013.01); *B41J 11/30* (2013.01); *B41J 15/048* (2013.01); *B65H 20/20* (2013.01)

(58) Field of Classification Search

CPC ..... B41J 11/006; B41J 15/048; B41J 11/04; B41J 2/22; B41J 11/30; B65H 20/20; B65H 2801/12; B65H 2601/255

See application file for complete search history.

(56) References Cited

U.S. PATENT DOCUMENTS

2002/0117578 A1* 8/2002 Denen ..... A47K 10/3625 242/563

2012/0298711 A1 11/2012 Kitahara

* cited by examiner

*Primary Examiner* — Justin Seo

(74) *Attorney, Agent, or Firm* — Kim & Stewart LLP

(57) ABSTRACT

A printer includes a feeding roller, a sheet conveyer, and a handle. The feeding roller is configured to feed a single slip and a continuous sheet conveyed through first and second conveyance paths, respectively, to a printing head. The sheet conveyer is at the second conveyance path. The handle is mechanically engaged with a shaft of the feeding roller and configured to rotate the shaft. The handle is manually movable along an axis direction of the shaft between first and second positions. At the first position, the handle is mechanically disengaged with a driving mechanism of the sheet conveyer. At the second position, the handle is mechanically engaged with the driving mechanism and capable of moving the sheet conveyer. An urging mechanism is urging the handle toward the first position. A stopper is configured to prevent the handle at the second position from moving toward the first position.

18 Claims, 9 Drawing Sheets

MANUAL SHEET JAM CLEARANCE IN PRINTER

CROSS-REFERENCE TO RELATED APPLICATION

This application is based upon and claims the benefit of priority from Japanese Patent Application No. 2018-078333, filed on Apr. 16, 2018, the entire contents of which are incorporated herein by reference.

FIELD

Embodiments described herein relate generally to a printer.

BACKGROUND

In a related art, there is a printer usable for both of a single slip and a continuous slip (continuous sheet). Such a printer includes a sheet feeding path for the single slip and a sheet feeding path for the continuous slip. The sheet feeding paths join in a printing module.

A known printer includes a handle rotatable for removing a sheet jammed in the paper feeding path, the printing module, or the like. The handle is directly connected to a roller that feeds the sheet at the printing module. If a sheet jam occurs, a user rotates the handle to rotate the roller directly and thus the jammed sheet is fed in a discharge direction.

The handle may be movable between a first position and a second position separated along the axial direction of the roller. If the handle is rotated at the first position, the roller feeds the single slip. If the handle is rotated at the second position, the roller feeds the continuous slip.

In the printer described above, the handle stays at one (e.g., first position) of the first position and the second position without any user interaction. If the handle has to be at the other position (e.g., second position), the user may be required to move the handle to the other position every time the intended operation is performed. It is desirable for the user to use the handle more conveniently.

DESCRIPTION OF THE DRAWINGS

FIG. 8 illustrates a cross-sectional view of the stopper in a state in which the stopper is pushed in.

DETAILED DESCRIPTION

A printer includes a printing head, a feeding roller, a sheet conveyer, a handle, an urging mechanism, and a stopper. The feeding roller is configured to feed a single slip conveyed through a first conveyance path to the printing head and a continuous sheet conveyed through a second conveyance path to the printing head. The sheet conveyer is at the second conveyance path and configured to convey the continuous sheet to the feeding roller. The handle is mechanically engaged with a shaft of the feeding roller and configured to rotate the shaft in response to a manual rotation of the handle. The handle is manually movable along an axis direction of the shaft between a first position and a second position. At the first position, the handle is mechanically disengaged with a driving mechanism of the sheet conveyer. At the second position, the handle is mechanically engaged with the driving mechanism of the sheet conveyer and capable of moving the sheet conveyer according to the manual rotation of the handle. The urging mechanism is urging the handle toward the first position. The stopper is configured to prevent the handle at the second position from moving toward the first position with an urging force by the urging mechanism.

First Embodiment

A first embodiment is described with reference to the accompanying drawings. In the figures, for convenience, a width direction of a housing 2 of a computer for clerical use 1 (hereinafter referred to simply as a computer) is referred to as an X-direction, a depth direction of the housing 2 thereof is referred to as a Y-direction, and a height direction of the housing 2 thereof is referred to as a Z-direction. The X-direction, the Y-direction, and the Z-direction are orthogonal to one another. In the following description, the near side in the Y-direction from an operator (a user) who uses the computer 1 is referred to as a front side of the computer 1 (or housing 2), and the inner side in the Y-direction is referred to as a rear side.

Figure 1:
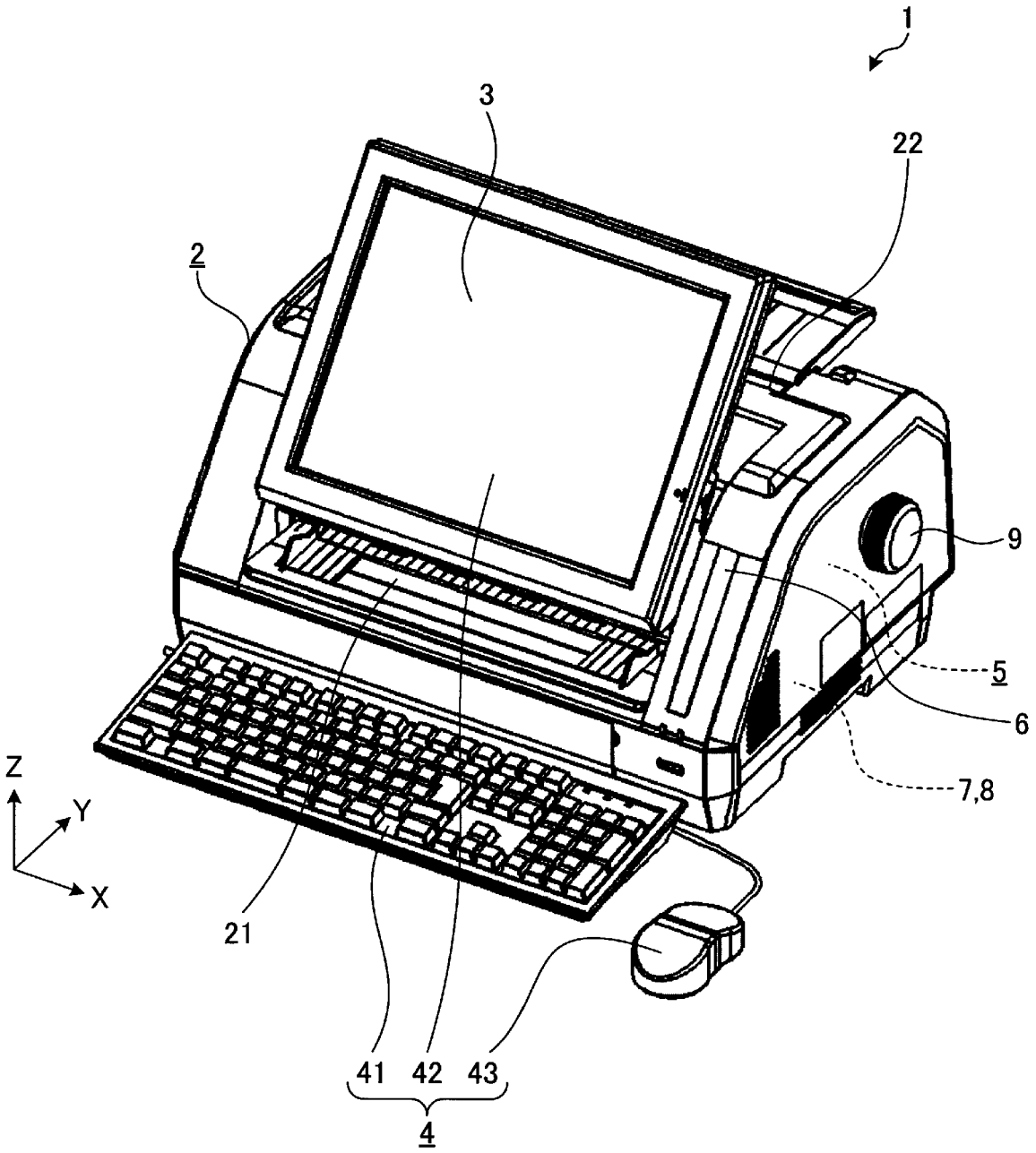
FIG. 1 illustrates a perspective view of an exterior of a computer for clerical use in a first embodiment.

FIG. 1 illustrates a perspective view of an exterior of the computer 1 including a printer according to the present embodiment. The computer 1 has a function of feeding a slip and a function of printing and issuing the fed slip. The printing and issuing function is performed by the printer included in the computer 1.

The slip is made by laying a plurality of printing media one on top of another. The printer that prints the slip copies the same content on each of the printing media in one printing operation. The slip includes a single slip and a continuous slip (a type of continuous paper). The single slip is a single unit which is cut one by one. The continuous slip is a connected units of a plurality of single units.

The computer 1 includes the housing 2, a display 3, an operation panel 4, a printer 5, a disk drive 6, a controller 7, and memory 8. The housing 2 houses the printer 5, the disk drive 6, the controller 7, and the memory 8. The housing 2 is formed in a substantially trapezoidal shape when viewed from a side.

The display 3 is, for example, a liquid crystal display and is provided on the front surface of the housing 2. The display 3 displays a screen of an input format of the slip. The operation panel 4 includes a keyboard 41, a touch panel 42, and a mouse 43.

The keyboard 41 includes a ten key, character keys, function keys, and the like arrayed thereon. The keyboard 41 is placed in front of a lower part of the housing 2 when it is used. The keyboard 41 is arranged independently from the housing 2 and can be freely moved against the housing 2. The keyboard 41 may be arranged to be fixed to or integral with the housing 2.

The touch panel 42 is laminated on a display surface of the display 3. The touch panel 42 outputs a signal corresponding to a touched position to receive an operation corresponding to a display content on the display 3 indicated with the touched position. In the following description, an operation performed through the touch panel 42 is simplified as "operating a key displayed on the display 3".

The mouse 43 is a type of a pointing device. The mouse 43 reflects a movement relative to a desk surface or the like on a movement of a pointer on a screen and receives an operation corresponding to a display content on the display 3 at a position at which the pointer is displayed.

The disk drive 6 is a type of an auxiliary storage device. The disk drive 6 rotates a disk-like medium (CD (Compact Disc), a DVD (Digital Versatile Disc), a BD (Blue-ray Disc), or the like) inserted into the inside of the disk drive 6 from the front side of the housing 2 and optically reads information from the medium. The disk drive 6 may have a function of optically writing information in the medium.

The controller 7 includes a CPU (Central Processing Unit), a ROM (Read Only Memory), and a RAM (Random Access Memory). The controller 7 controls each component of the computer 1. The memory 8 may be nonvolatile memory such as an HDD (Hard Disc Drive) or flash memory that retains stored information even if an electric power is turned off. The memory 8 stores various computer programs. The CPU develops computer programs stored in the ROM and the memory 8 on the RAM to execute the computer programs, and thus the controller 7 performs various kinds of control processing.

Figure 2:
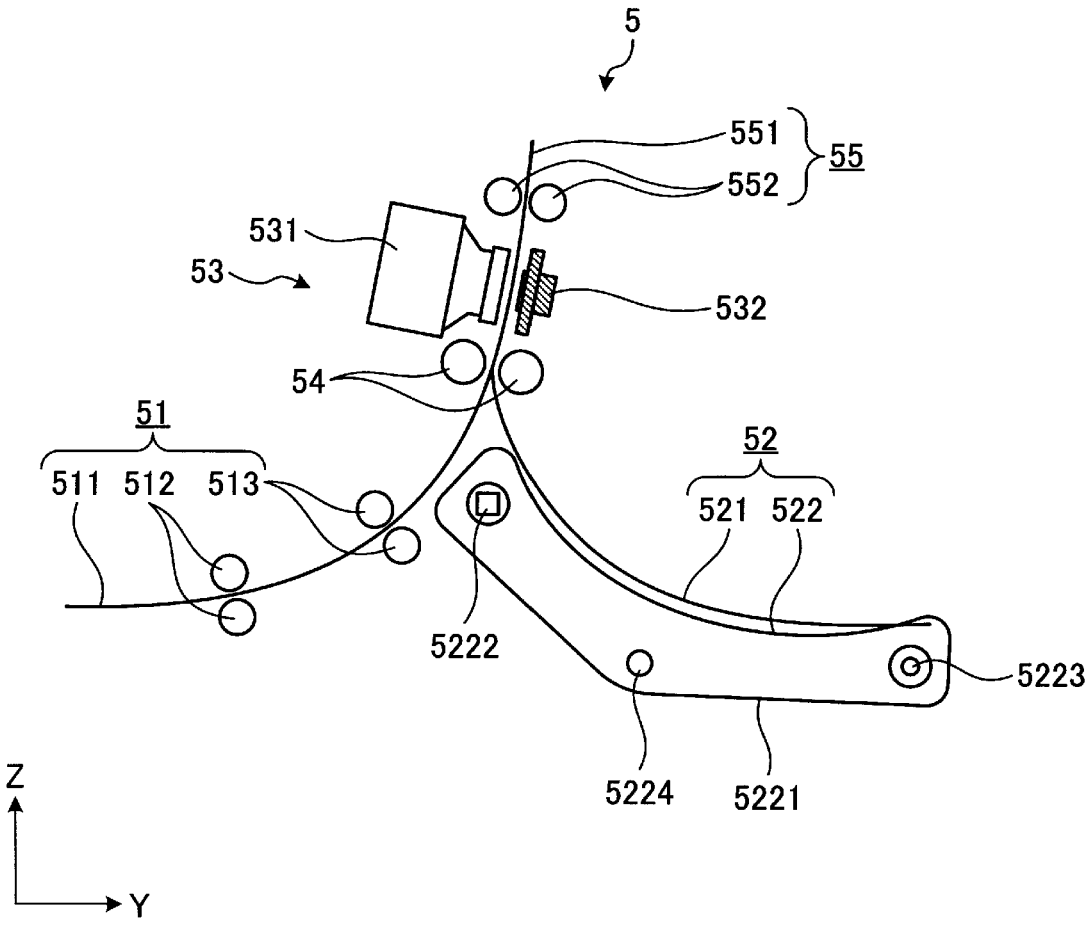
FIG. 2 is a diagram schematically illustrating a structure of a printer.

FIG. 2 is a diagram schematically illustrating a structure of the printer 5. The printer 5 is enclosed in the housing 2 as described above. FIG. 2 shows positional relationship of each component or unit of the printer 5 at one of the sides without the housing 2. The left side in FIG. 2 is the front side of the housing 2. The right side in FIG. 2 is the rear side of the housing 2. The printer 5 has the same structure as shown in FIG. 2 at the other side thereof as a pair. However, only the structure of the printer 5 shown in FIG. 2 is described hereafter for the sake of simplicity.

The printer 5 includes a first paper feeder 51, a second paper feeder 52, a printing module 53, feeding rollers 54, and a paper discharging unit 55.

The first paper feeder 51 includes a conveying path 511, pull-in rollers 512, and paper feeding rollers 513 to draw a single slip into the conveying path 511. The conveying path 511 is led to the printing module 53, and the single slip drawn in from a paper feeding port 21 (refer to FIG. 1), provided on the front surface of the housing 2, passes along the conveying path 511. The pull-in rollers 512 are a pair of rollers arranged along the conveying path 511. The pull-in rollers 512 pull the single slip inserted through the paper feeding port 21 into the conveying path 511 at a predetermined timing. The paper feeding rollers 513 are a pair of rollers arranged at a position next to the pull-in rollers 512 along the conveying path 511. The paper feeding rollers 513 convey the single slip pulled in by the pull-in rollers 512. Operation timings of the pull-in rollers 512 and the paper feeding rollers 513 follow the control by the controller 7.

The second paper feeder 52 includes a conveying path 521 and a tractor 522 to draw a continuous slip into the conveying path 521. The conveying path 521 is led to the printing module 53, and the continuous slip drawn in from a paper feeding port, provided on the rear surface of the housing 2, passes along the conveying path 521. The continuous slip is formed by connecting slips in a belt shape. The continuous slip includes, on both edge surfaces along the longitudinal direction thereof, holes continuous at predetermined intervals in the longitudinal direction of the continuous slip.

The tractor 522 includes a pin belt 5221, a driving shaft 5222, and driven shafts 5223 and 5224. The driving shaft 5222 is an example of a driving component to which a driving force from a power source is transmitted. The tractor 522 is an example of a sheet conveyer for moving the continuous slip taken in by the second paper feeder 52 toward a printing position along the second conveying path 521. The tractor 522 operates according to rotation of the driving shaft 5222 provided in parallel to the feeding rollers 54.

The pin belt 5221 is an endless belt including protrusions continuously provided at predetermined intervals the same as that of the holes on the continuous slip along the longitudinal direction of the endless belt. The pin belt 5221 is disposed at a position corresponding to the edge surface of the continuous slip at which holes are provided continuously. The driving shaft 5222 and the driven shafts 5223 and 5224 support the pin belt 5221 from the inner side and keep the pin belt 5221 in a state in which the pin belt 5221 is stretched with an appropriate tension. The driving shaft 5222 receives a driving force of a driving source such as a motor to rotate the pin belt 5221. Such a tractor 522 feeds the continuous slip toward the printing module 53 in such a way that the holes on the edge surface of the continuous slip are fit with the protrusions of the pin belt 5221 and the pin belt 5221 rotates. Operation timing of the driving shaft 5222 follows the control by the controller 7.

The printing module 53 includes a printing head 531 and a platen 532. The printing head 531 is, for example, a dot impact head. The printing head 531 prints a printing object present at the printing position thereof. The platen 532 is disposed opposite to the printing head 531 to sandwich the printing object therebetween and holds the printing object at the printing position while the printing object is printed. The printing module 53 prints the slip (single slip or continuous slip) fed between the printing head 531 and the platen 532 according to the control by the controller 7. If the printing head 531 is the dot impact head, a pressure sensitive copying paper or a back carbon copying paper is used as a slip.

The feeding rollers 54 are a pair of rollers disposed at a position closest to the printing module 53. The feeding rollers 54 move the slip fed into the feeding rollers 54 by the first paper feeder 51 or the second paper feeder 52 to the printing module 53 at an appropriate timing. Operation timing of the feeding rollers 54 follows the control by the controller 7.

The paper discharging unit 55 includes a conveying path 551 and paper discharging rollers 552. The conveying path 551 is led to a paper discharge port 22 (refer to FIG. 1) provided on the top surface of the housing 2. The single slip and the continuous slip passing through the printing module 53 are conveyed along the conveying path 551 to be discharged from the paper discharge port 22. The paper discharging rollers 552 are a pair of rollers opposed to each other across the conveying path 551. The paper discharging rollers 552 feed the single slip and the continuous slip passing through the conveying path 551 to the paper discharge port 22. The paper discharging rollers 552 rotate following the feeding rollers 54. The feeding rollers 54 and the paper discharging rollers 552 receive transmission of a rotational movement by a gear, a belt, or the like to perform respective conveying operations synchronized with each other.

The controller 7 includes a plurality of operation modes and operates in one of the operation modes according to a selection operation by the user. The operation modes include, for example, a "single slip mode" and a "continuous slip mode". In the single slip mode, an operation suitable for printing and issuing of the single slip can be performed. In the continuous slip mode, an operation suitable for printing and issuing of the continuous slip can be performed.

During the operation in the single slip mode, the controller 7 rotates the feeding rollers 54 and the paper feeding rollers 513 according to a printing operation of the printing module 53 to print the single slip. During the operation in the continuous slip mode, the controller 7 rotates the feeding rollers 54 and the driving shaft 5222 of the tractor 522 according to the printing operation of the printing module 53 to print the continuous slip.

Figure 3:
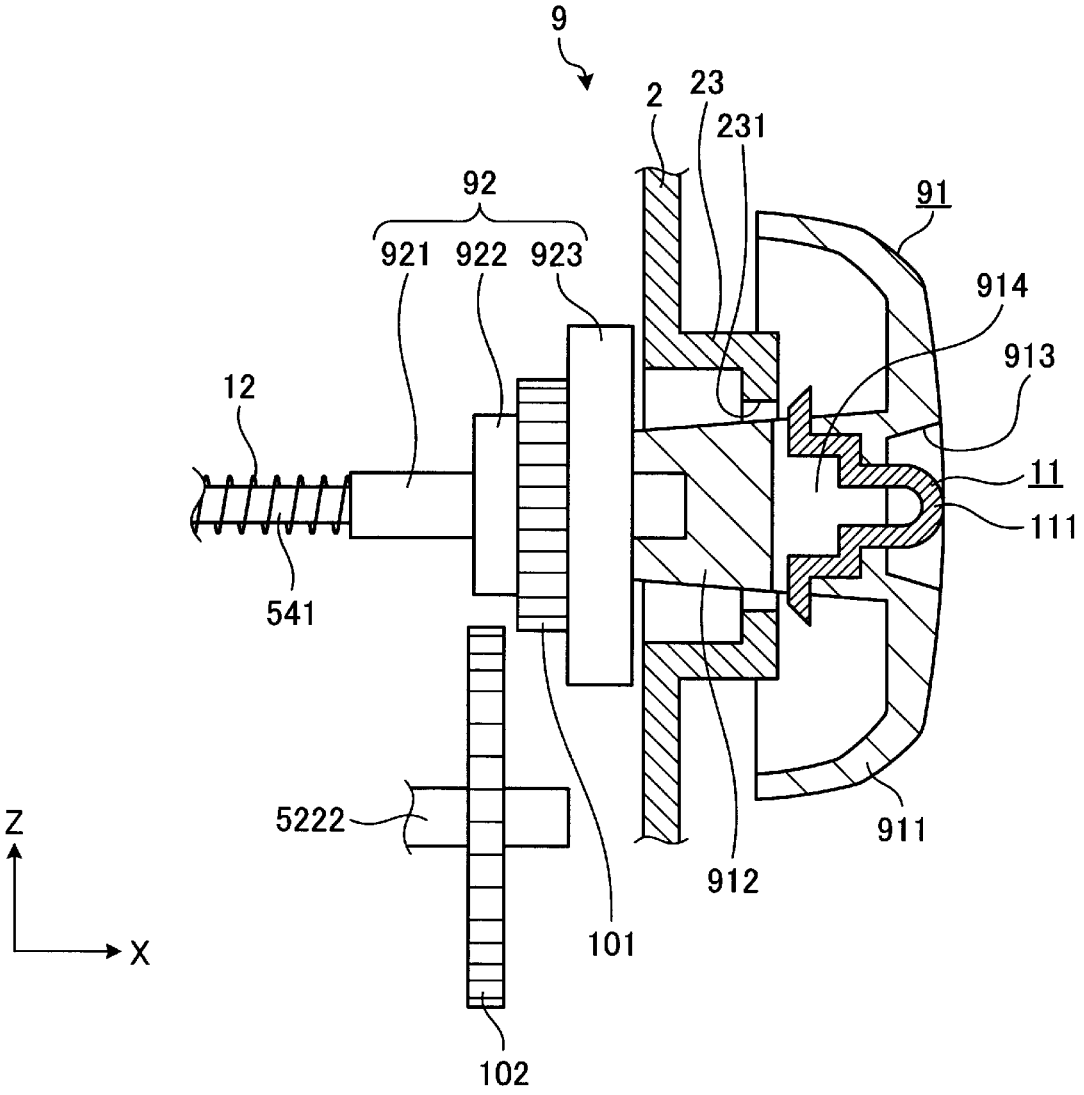
FIG. 3 illustrates a cross-sectional view of mechanisms of the printer, including a structure of a handle, an interlocking mechanism, a stopper, and an urging mechanism, at a first position.
Figure 4:
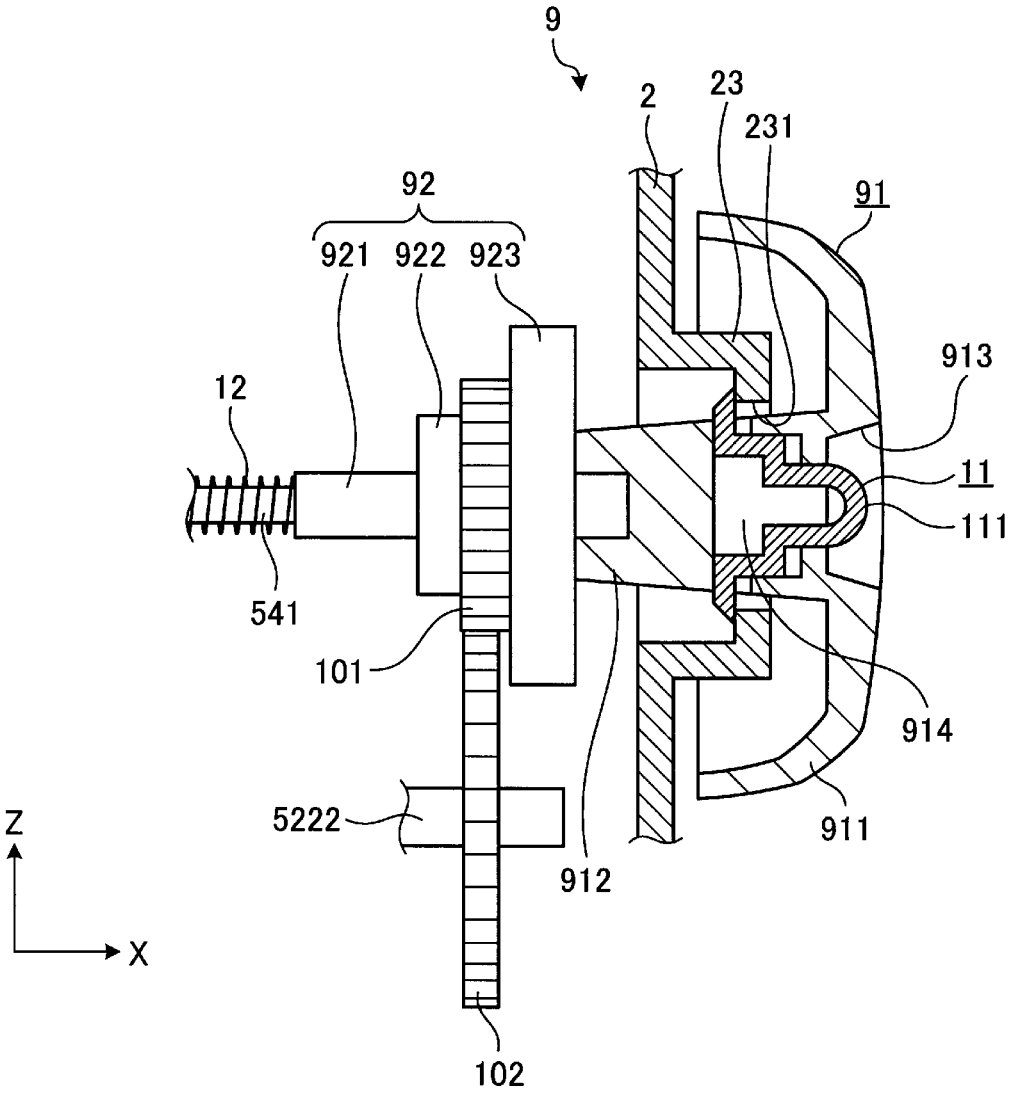
FIG. 4 illustrates a cross-sectional view of the mechanisms at a second position.
Figure 5A:
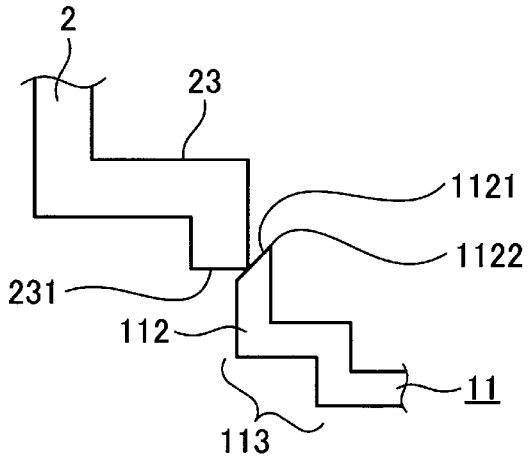
FIGS. 5A-5C illustrate cross-sectional views of the stopper to illustrate a movement of the stopper to a housing.
Figure 5B:
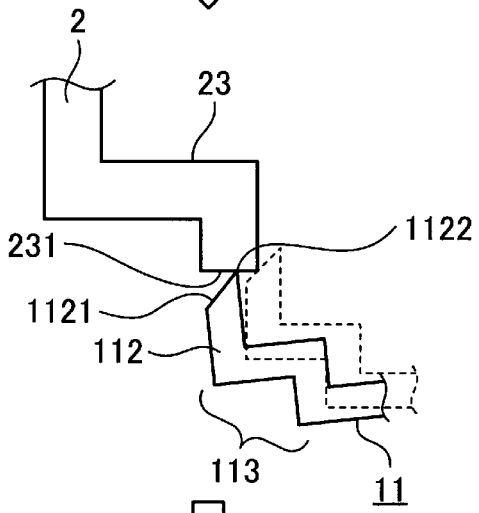
Figure 5C:
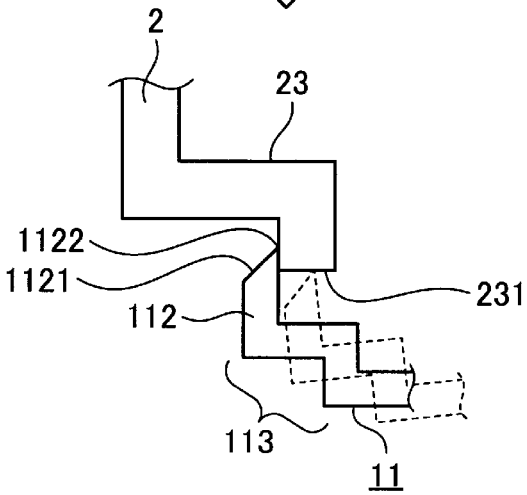
Figure 5C:
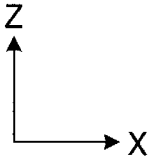

The computer 1 further includes a handle 9 and an interlocking mechanism 10, a stopper 11, and an urging mechanism 12 illustrated in FIGS. 3 and 4, at the right side of the housing 2. FIG. 3 illustrates a cross-sectional view of the structure of each mechanism (handle 9, interlocking mechanism 10, stopper 11, and urging mechanism 12) at a first position. FIG. 4 illustrates a cross-sectional view of the structure of the mechanisms at a second position.

The handle 9 is used to manually rotate the feeding rollers 54 to solve a paper jam in the printing module 53. The handle 9 includes a knob 91 and a connecting section 92. The interlocking mechanism 10 includes a first gear 101 and a second gear 102.

The handle 9 receives operation by the operator if the operator manually rotates the feeding rollers 54. The handle 9 is attached to a shaft 541 of the feeding rollers 54 such that it is movable between the first position and the second position separated along the longitudinal direction of the shaft 541.

The first gear 101 moves in response to movement of the handle 9 and is an example of a first transmitting section that transmits rotation of the shaft 541 to another member (second gear 102 in the present embodiment) if the handle 9 is located at the second position. The second gear 102 is attached to the driving shaft 5222 and is an example of a second transmitting section that receives the rotation of the shaft 541 via the first gear 101 and transmits the received rotation to the driving shaft 5222 if the handle 9 is located at the second position.

The connecting section 92 is a portion for holding the shaft 541 of the feeding rollers 54. The handle 9 including the connecting section 92, and the shaft 541 are incapable of rotating with each other. The handle 9 including the connecting section 92 is slidable against the shaft 541 in a predetermined range along the axial direction of the shaft 541. One of both ends of the sliding range is referred to as the first position and the other is referred to as the second position. The first position is a position at which the handle 9 mostly moves in a direction away from the housing 2 within the sliding range. The second position is a position at which the handle 9 mostly moves in a direction in which the handle 9 is pushed to the housing 2.

The urging mechanism 12 is an example of a first holding mechanism that holds the handle 9 at the first position. The urging mechanism 12 is, for example, a helical spring. The urging mechanism 12 urges the handle 9 to a direction toward the outer side of the housing 2 (right side in FIG. 3). Consequently, in a state in which a force (external force) by the user is not applied to the handle 9, the handle 9 is located at the first position.

The connecting section 92 includes a portion 921 to which the shaft 541 is attached, a portion 922 to which the first gear 101 is attached, and a portion 923 that positions the first gear 101 to function as a stopper for preventing the first gear from slipping off out of the housing 2. The knob 91 is attached to a side opposite to a side at which the portion 923 is in contact with the first gear 101.

The knob 91 includes a large diameter section (part) 911 and a small diameter section (part) 912 having a smaller diameter than that of the large diameter section 911. The small diameter section 912 is a portion projecting from a side of the housing 2 the large diameter section 911 faces. The connecting section 92 is attached to the small diameter section 912. The large diameter section 911 is a portion gripped by the user who operates the handle 9.

The housing 2 includes a projecting section 23 at a portion at which the handle 9 is disposed and a hole 231 in the center of the projecting section 23. The small diameter section 912 protrudes through the hole 231. The large diameter section 911 is formed in a shape curved toward the housing 2 side to cover the periphery of the projecting section 23 with an outer circumferential wall of the large diameter section 911.

The stopper 11 is an example of a second holding mechanism that is provided in the handle 9 to hold, at the second position, the handle 9 moved from the first position to the second position. The stopper 11 is formed in a substantial U-shape and includes a head section 111 formed in a curved shape in the center thereof, engaging ends 112 (see FIG. 5) formed at both ends thereof, and spring sections 113 (see FIG. 5) between the head section 111 and the engaging ends 112. The stopper 11 is formed by molding, for example, resin. The head section 111 and the spring sections 113 are formed in an elastically deformable shape. The stopper 11 is fit in an attachment hole 914 provided in the small diameter section 912. The head 111 projects into a recessed section 913 provided in the center of the large diameter section 911.

FIG. 5 illustrates a cross-sectional view of the stopper 11 to illustrate movement of the stopper 11 to the housing 2. The handle 9 goes through operations in first, second, and third stages (initial period, intermediate period, and end period) indicated by alphabetical characters (a), (b), and (c) in FIG. 5 while the handle 9 moves from the first position illustrated in FIG. 3 to the second position illustrated in FIG. 4. The handle 9 is pushed into the housing 2 side against the urging force of the urging mechanism 12 and thus the engaging ends 112 and the spring sections 113 of the stopper 11 operate as illustrated in FIG. 5.

In the first stage, slopes 1121 at the distal end portions of the engaging ends 112 come into contact with the edge of the hole 231. In the second stage, the slopes 1121 slide on the edge of the hole 231 and terminal ends 1122 of the slopes 1121 move in directions in which the terminal ends 1122 approach each other to contact with the inner periphery of the hole 231. In the third stage, the terminal ends 1122 protrude through the hole 231 to reach the inner side of the projecting section 23. In the first to second stages, the spring sections 113 bend and thus the terminal ends 1122 move in the directions in which the terminal ends 1122 approach each other. In the third stage, since the positions of the terminal ends 1122 are not restricted by the hole 231, the stopper 11 returns to the original shape with a spring property of the spring sections 113. In the third stage, the handle 9 is held at the second position while being prevented from coming off by engagement between the stopper 11 and the hole 231.

The head section 111 serves as a portion manipulated by the user. The head section 111 is manipulated by the user and thus the stopper 11 is deformed to bring a pair of engaging ends 112 close to each other. Consequently, the terminal ends 1122 move in the directions in which they approach each other. If the interval between the terminal ends 1122 is smaller than the diameter of the hole 231, the engaging ends 112 can be pulled out from the hole 231. The handle 9 is pushed out by the urging force of the urging mechanism 12 and reaches the first position at which it is held.

In such an arrangement and operations described above, if a jam of the single slip occurs, the user manipulates the handle 9 at the first position and rotates the handle 9 (feeding rollers 54) to discharge jammed paper from the paper discharge port 22.

If a jam of the continuous slip occurs, first, the user pushes the handle 9 into the housing 2 side to locate the handle 9 at the second position. Thereafter, the user manipulates the handle 9 to rotate the handle 9 (feeding rollers 54) to discharge jammed paper from the paper discharge port 22. At the time the handle 9 is located at the second position, the rotation of the feeding rollers 54 is transmitted to the driving shaft 5222 via the first gear 101 and the second gear 102 and thus the tractor 522 feeds the continuous slip.

In this way, according to the present embodiment, usability of the handle 9 that is switchable to a plurality of positions and used in a plurality of manners can be improved. If the handle 9 is located at the second position, the handle 9 does not return to the first position even if the user takes his or her hand off the handle 9 because the position of the handle 9 is maintained by the stopper 11. Therefore, if the user operates the handle 9 at the second position, a troublesome operation of pushing the handle 9 every time the user takes his or her hand off the handle 9 can be omitted.

According to the present embodiment, the user can easily release the position retention by the stopper 11 simply by manipulating the head section 111 of the stopper 11.

In the present embodiment, the first gear 101 attached to the handle 9 and the second gear 102 attached to the driving shaft 5222 respectively serve as the first transmitting section and the second transmitting section. However, the first transmitting section and the second transmitting section may be implemented by members other than the gears or may be respectively implemented by combinations of pluralities of members.

In the present embodiment, the urging mechanism 12 is described as the example of the first holding mechanism. However, the first holding mechanism may not be the urging mechanism as long as the first holding mechanism can hold the handle 9 at the first position. For example, the first holding mechanism may be a member including a portion for engaging with the stopper 11 at the first position.

Further, in the present embodiment, the tractor 522 is described as the example of the conveying section. However, the conveying section is not limited to the tractor.

In the present embodiment, the feeding rollers 54 and the platen 532 are separate from one another. However, the feeding rollers 54 may be platen rollers functioning as a platen as well (serving as a platen as well). Further, the printing head 531 may be a printing head of another printing system (e.g., a thermal head) rather than the dot impact head.

Second Embodiment

A second embodiment is described with reference to the drawings. The second embodiment is a modification of the first embodiment. In the second embodiment, only changes from the first embodiment are described. Description of structures similar to that of the first embodiment is omitted. In the second embodiment, the stopper 11 described as the example of the second holding mechanism in the first embodiment is changed to stoppers 13.

Figure 6:
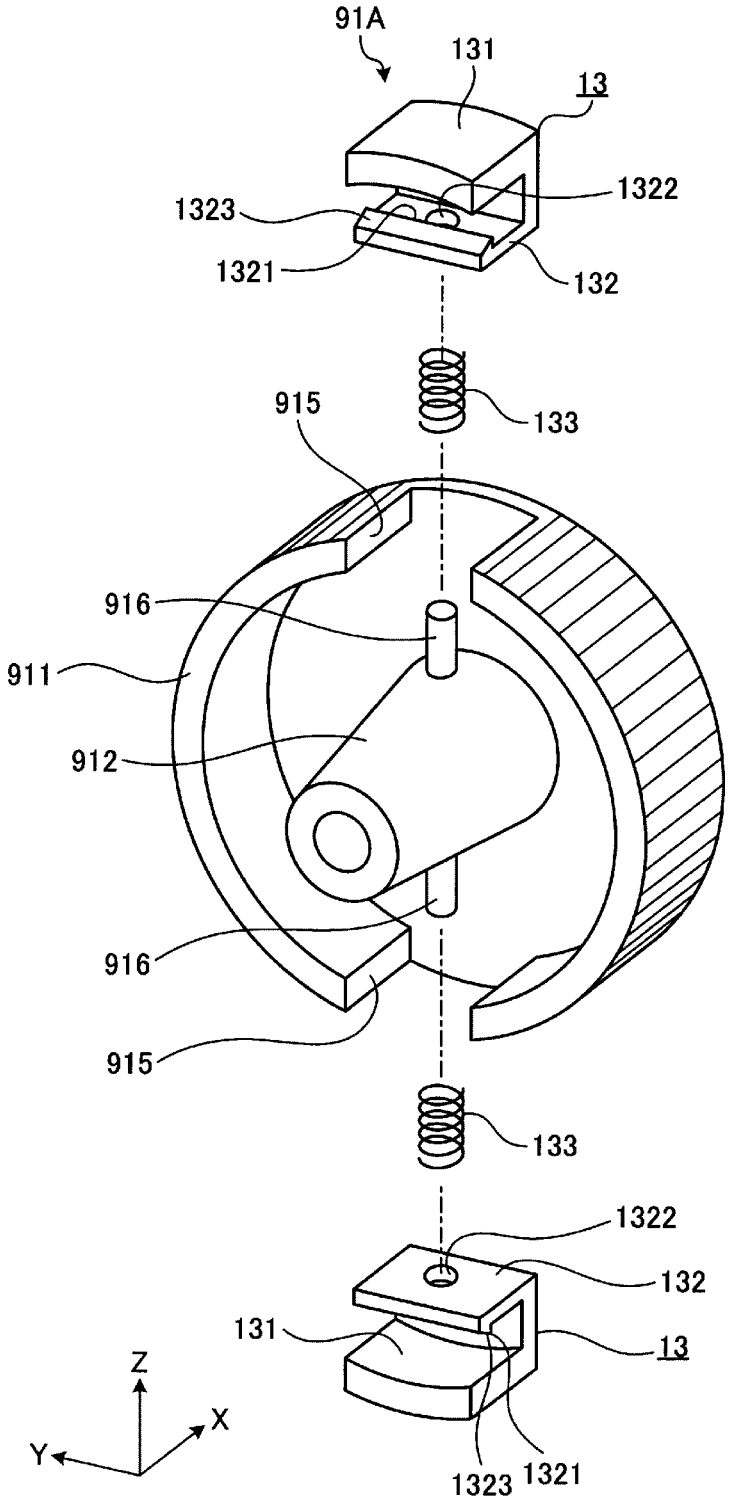
FIG. 6 illustrates an exploded perspective view of a structure of a knob in a second embodiment.

FIG. 6 illustrates an exploded perspective view of a structure of a knob 91A in the present embodiment. The stoppers 13 are fit in cutout sections 915 provided in two parts opposed to each other across the center of the outer circumferential portion of the knob 91A. The stoppers 13 include outer side sections 131 coinciding with the outer circumferential portion of the knob 91A in a state in which the stoppers 13 are respectively fit in the cutout sections 915 and inner side sections 132, located at the inner sides of the outer side sections 131, which are opposed to the outer side sections 131. The outer side sections 131 and the inner side sections 132 are integrated. The stoppers 13 further include urging mechanisms 133 sandwiched between the inner side sections 132 and the small diameter section 912. The urging mechanisms 133 are, for example, helical springs.

Figure 7:
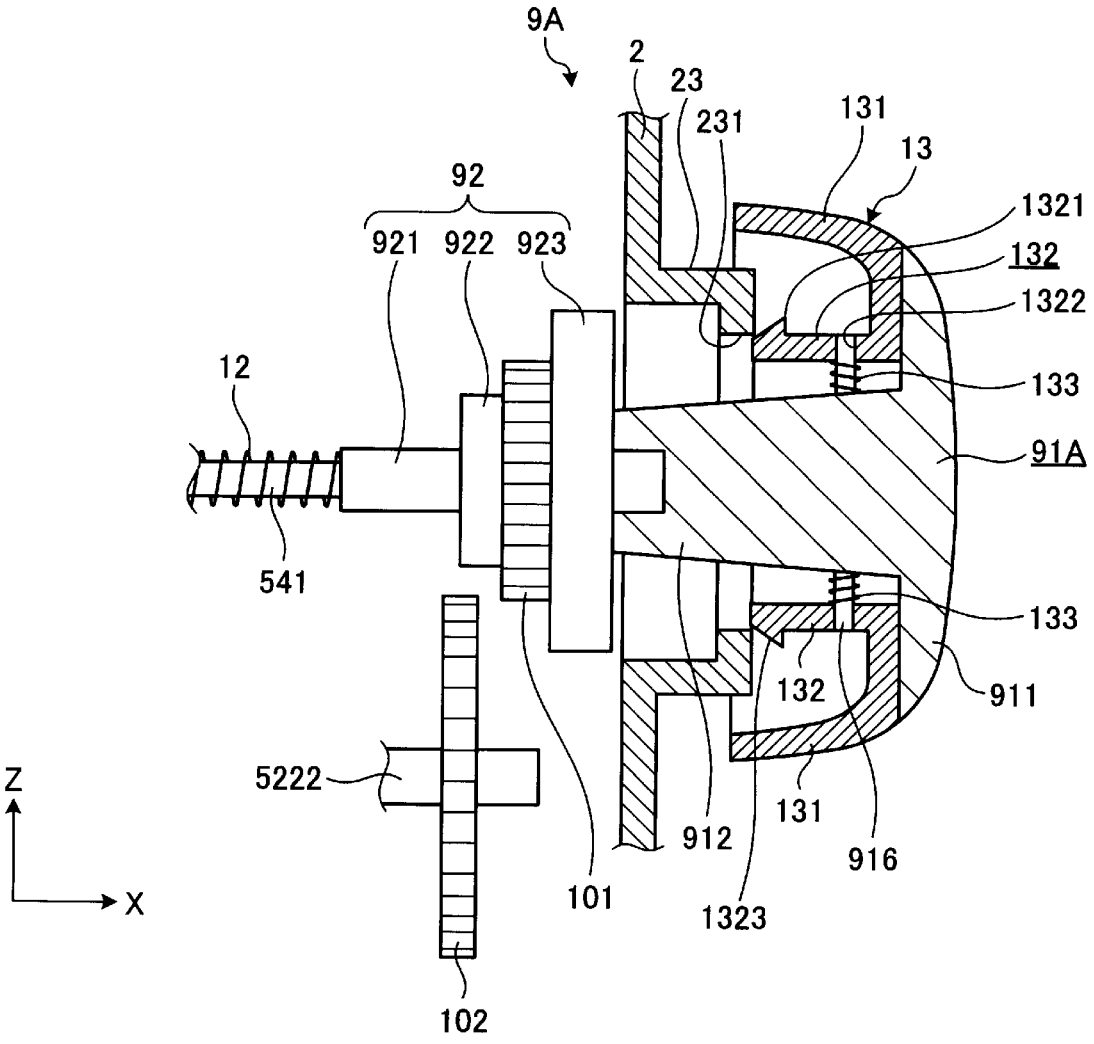
FIG. 7 illustrates a cross-sectional view of the handle at the first position.

FIG. 7 illustrates a cross-sectional view of a handle 9A at the first position. At the distal ends of the inner side sections 132, engaging ends 1321 having a hook-like shape caught by the edge of the hole 231 at the second position are provided. The inner side sections 132 include holes 1322. Shaft-like supporting sections 916 projecting along the radial direction outward from the outer circumferential surface of the small diameter section 912 protrude through the holes 1322.

In the knob 91A having such a structure, the stoppers are movable along the longitudinal direction of the supporting sections 916, i.e., the radial direction of the knob 91A. In a state in which the user does not apply a force to the stoppers 13, the stoppers 13 are urged by the urging mechanisms 133. The outer side sections 131 are located at positions coinciding with the outer circumferential portion of the knob 91A.

Figure 8:
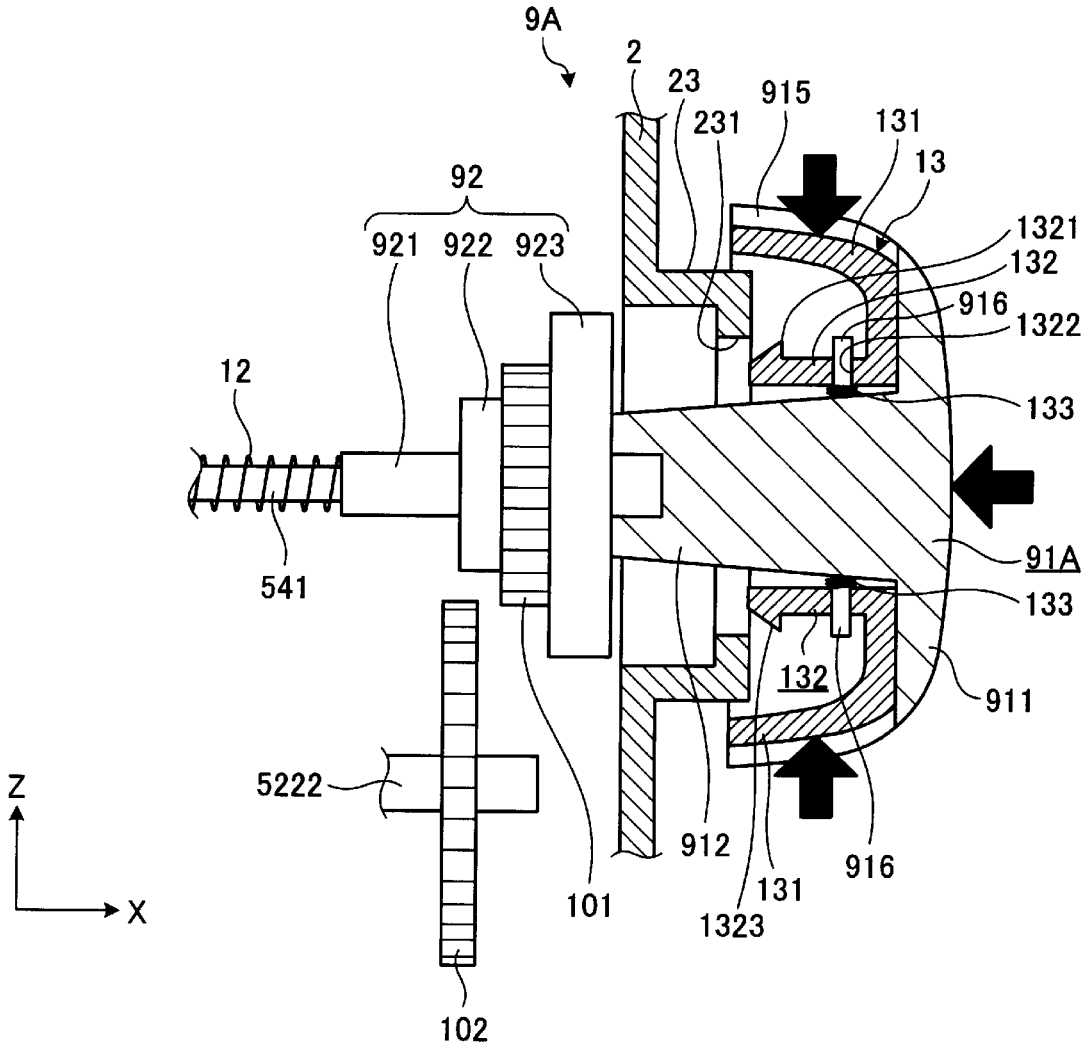
Figure 9:
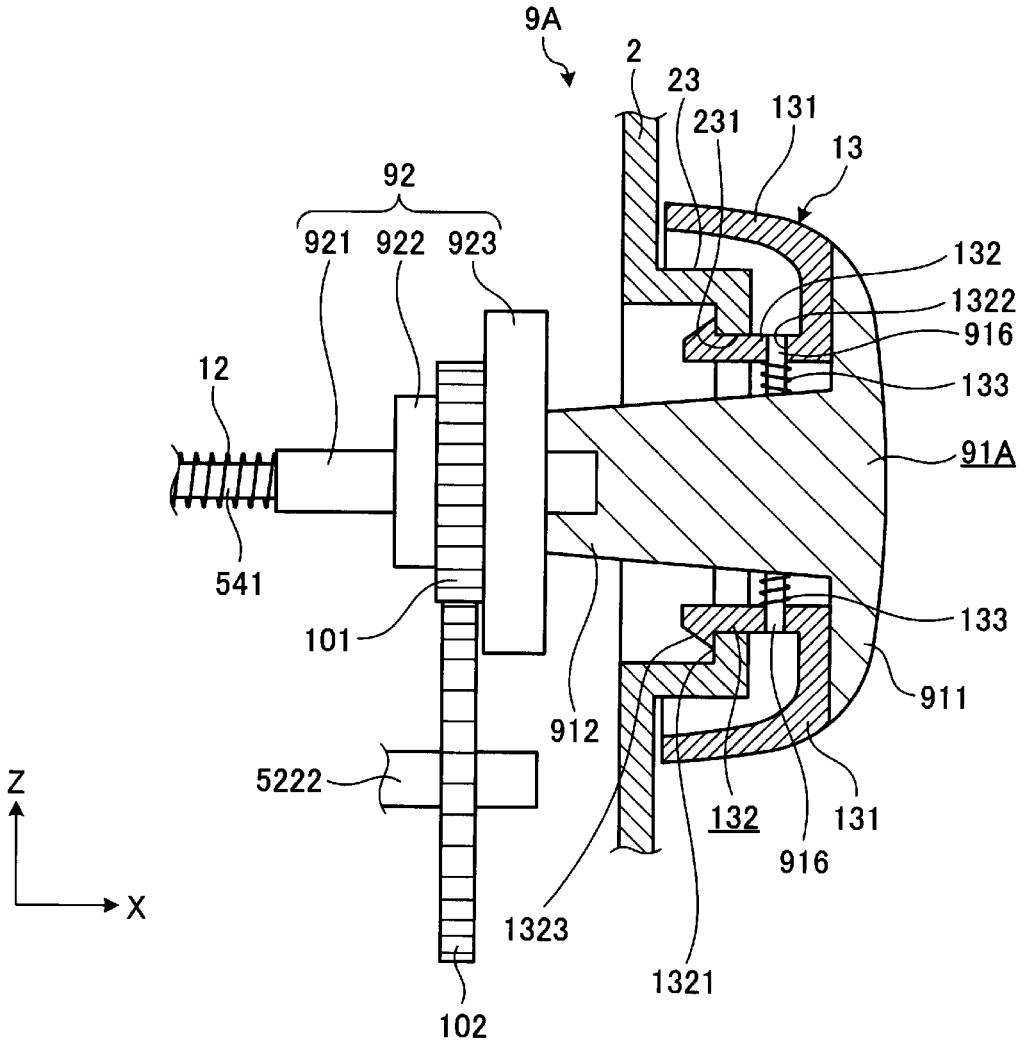
FIG. 9 illustrates a cross-sectional view of the handle at the second position.

FIG. 8 illustrates a cross-sectional view of the stopper 13 in a state in which the stoppers 13 are pushed in. The user pushes the stoppers 13 in toward the center of the knob 91A. In this state, the user further pushes the handle 9A into the housing 2 against the urging force of the urging mechanism 12 and releases the stoppers 13. Then, the handle 9A changes to the state illustrated in FIG. 9. FIG. 9 illustrates a cross-sectional view of the handle 9A at the second position.

At the time of returning the handle 9A to the first position, the user pushes the stoppers 13 toward the center of the knob 91A. The user allows the handle 9A to be pushed out according to the urging force of the urging mechanism 12. The user releases the stoppers 13 when the handle 9A returns to the first position.

In the present embodiment as well, the inner side sections 132 include slopes 1323 extending from the distal end portions to the engaging ends 1321. Therefore, the user can also move the handle 9A to the second position by pushing the handle 9A while sliding the slopes 1323 on the edge of the hole 231.

In this way, according to the second embodiment, the same effect as that in the first embodiment can be achieved.

While certain embodiments have been described, these embodiments have been presented by way of example only, and are not intended to limit the scope of the invention. Indeed, the novel methods and systems described herein may be embodied in a variety of other forms; furthermore, various omissions, substitutions and changes in the form of the methods and systems described herein may be made without departing from the spirit of the invention. The accompanying claims and their equivalents are intended to cover such forms or modifications as would fall within the scope and spirit of the invention.

What is claimed is:

1. A printer comprising:

a printing head;

a feeding roller configured to feed a single slip conveyed through a first conveyance path to the printing head and a continuous sheet conveyed through a second conveyance path to the printing head;

a sheet conveyer at the second conveyance path and configured to convey the continuous sheet to the feeding roller;

a handle mechanically engaged with a shaft of the feeding roller and configured to rotate the shaft in response to a manual rotation of the handle, the handle being manually movable along an axis direction of the shaft between a first position at which the handle is mechanically disengaged with a driving mechanism of the sheet conveyer and a second position at which the handle is mechanically engaged with the driving mechanism of the sheet conveyer and capable of moving the sheet conveyer according to the manual rotation of the handle;

an urging mechanism urging the handle toward the first position; and a stopper configured to prevent the handle at the second position from moving toward the first position with an urging force by the urging mechanism.

2. The printer according to claim 1, wherein the stopper is deformable to a state at which the stopper no longer holds the handle at the second position.

3. The printer according to claim 2, wherein the stopper has a portion exposed at a surface of the handle, and the stopper is manually deformable using the exposed portion.

4. The printer according to claim 3, wherein the handle includes a knob and the portion of the stopper is exposed at a surface of a center of the knob.

5. The printer according to claim 1, wherein the stopper includes an engaging portion manually movable between a third position at which the engaging portion allows movement of the handle from the second position to the first position and a fourth position at which the engaging portion prevents movement of the handle from the second position to the first position.

6. The printer according to claim 5, wherein the handle includes a portion mechanically engaged with the stopper and configured to move the stopper between the third position and the fourth position.

7. The printer according to claim 6, wherein the engaging portion of the stopper is urged toward the third position by an urging member.

8. The printer according to claim 5, wherein the stopper includes a second engaging portion manually movable between a fifth position at which the second engaging portion allows movement of the handle from the second position to the first position and a sixth position at which the second engaging portion prevents movement of the handle from the second position to the first position.

9. The printer according to claim 8, wherein the first engaging portion and the second engaging portion of the stopper are opposite in a radial direction of the handle across a center of the handle.

10. The printer according to claim 1, wherein the urging mechanism includes a spring.

11. The printer according to claim 1, wherein a first gear of the handle is mechanically engaged with a second gear of the driving mechanism of the sheet conveyer when the handle is at the second position.

12. The printer according to claim 1, wherein the printing head is a dot impact head.

13. The printer according to claim 1, wherein the feeding roller is included in a platen facing the printing head.

14. The printer according to claim 1, wherein the sheet conveyer includes an endless belt having a surface on which the continuous sheet is conveyed.

15. A manual operation method of a printer including a printing head, a feeding roller configured to feed a single slip conveyed through a first conveyance path to the printing head and a continuous sheet conveyed through a second conveyance path to the printing head, a sheet conveyer at the second conveyance path and configured to convey the continuous sheet to the feeding roller, and a handle mechanically engaged with a shaft of the feeding roller, the operation method comprising:

when the single slip is jammed, rotating the handle at a first position along an axis direction of the shaft to rotate the feeding roller, the handle being mechanically disengaged with a driving mechanism of the sheet conveyer at the first position;

when the continuous sheet is jammed, moving the handle from the first position to the second position along the axis direction of the shaft against an urging force of an urging mechanism urging the handle toward the first position, such that the handle is held at the second position by a stopper against the urging force, the handle being mechanically engaged with the driving mechanism of the sheet conveyer at the second position; and rotating the handle at the second position to move the sheet conveyer and rotate the feeding roller.

16. The manual operation method of claim 15, further comprises releasing the handle that is held at the second position by the stopper, to cause the handle to move from the second position to the first position with the urging force of the urging mechanism.

17. The manual operation method of claim 16, wherein said releasing the handle that is held at the second position by the stopper comprises deforming the stopper.

18. The manual operation method of claim 16, wherein said releasing the handle that is held at the second position by the stopper comprises moving an engaging portion from and a third position at which the engaging portion prevents movement of the handle from the second position to the first position to a fourth position at which the engaging portion allows movement of the handle from the second position to the first position.

* * * * *